United States Patent [19]

Friedrich

[11] Patent Number: 5,019,194

[45] Date of Patent: May 28, 1991

[54] METHOD FOR MANUFACTURING A WEB OF PLASTIC TURF FOR SPORTS GROUNDS

[75] Inventor: Hans-Joachim Friedrich, Auenwald, Fed. Rep. of Germany

[73] Assignee: J. F. Adolff AG, Backnang, Fed. Rep. of Germany

[21] Appl. No.: 352,773

[22] Filed: May 15, 1989

Related U.S. Application Data

[63] Continuation of Ser. No. 145,837, Jan. 20, 1988, abandoned.

[30] Foreign Application Priority Data

Jan. 29, 1987 [DE] Fed. Rep. of Germany ..... 3702575
Sep. 2, 1987 [DE] Fed. Rep. of Germany ..... 3729267

[51] Int. Cl.[5] ..... B32B 31/00

[52] U.S. Cl. ..... 156/61; 156/79; 156/209; 156/244.24; 156/244.25; 156/270; 428/17; 428/95

[58] Field of Search ..... 156/61, 72, 78, 79, 156/209, 220, 244.24, 270; 428/17, 95

[56] References Cited

U.S. PATENT DOCUMENTS 3,236,926 2/1966 Wisotzky ..... 156/209
4,007,307 2/1977 Friedrich ..... 428/95
4,278,482 7/1981 Poteet ..... 156/209
4,405,665 9/1983 Beaussier ..... 428/17
4,535,021 8/1985 Friedrich ..... 428/95
4,637,942 1/1987 Tomarin ..... 428/96

FOREIGN PATENT DOCUMENTS 2051108 4/1970 Fed. Rep. of Germany .
1933180 4/1972 Fed. Rep. of Germany .
3113636 10/1982 Fed. Rep. of Germany .

*Primary Examiner*—George F. Lesmes
*Assistant Examiner*—J. Davis
*Attorney, Agent, or Firm*—Joseph P. Calabrese

[57] ABSTRACT

In a method for manufacturing a web of a ground covering having a web of pile fabric forming the upper side and cushion elements attached to its underside in grating-type configuration, in order to simplify the manufacturing process, plastic agglomerates corresponding to the cushion elements are produced from a pasty plastics material from which an elastomer is formable by curing, and are deposited in grating-type configuration on an endless conveyer belt; first a reinforcement web with openings therein and next the underside of the web of pile fabric are then placed on the plastic agglomerates such that the plastics material penetrates the openings in the reinforcement web and wets the underside of the web of pile fabric; the plastics material is subsequently cured by heat treatment and the web of pile fabric, the reinforcement web and the cushion elements are thereby firmly bonded to one another.

9 Claims, 4 Drawing Sheets

FIG. 2
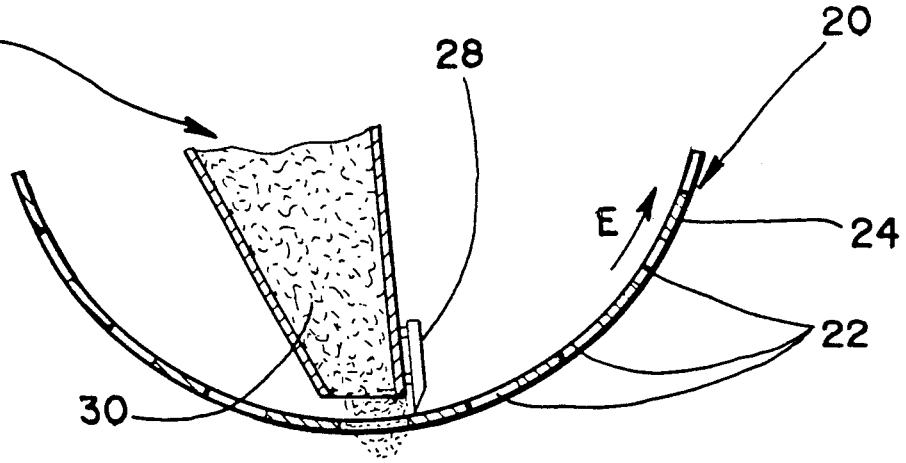
FIG. 3
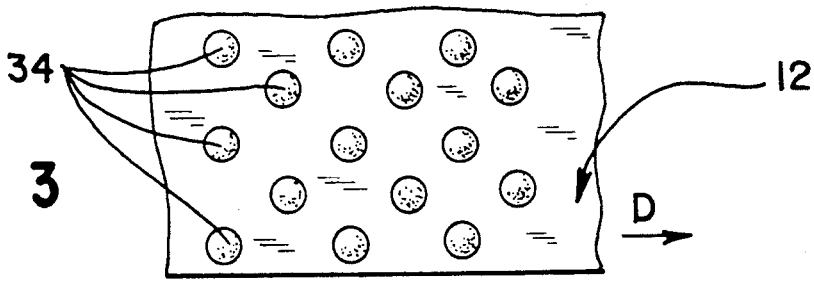
FIG. 4
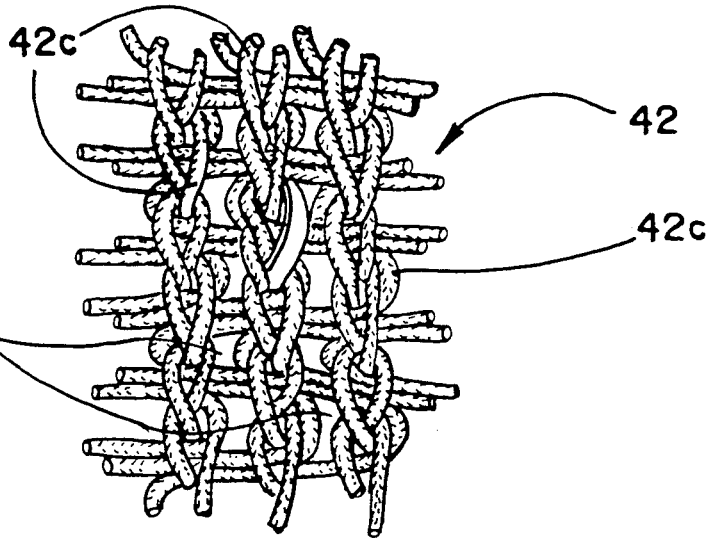
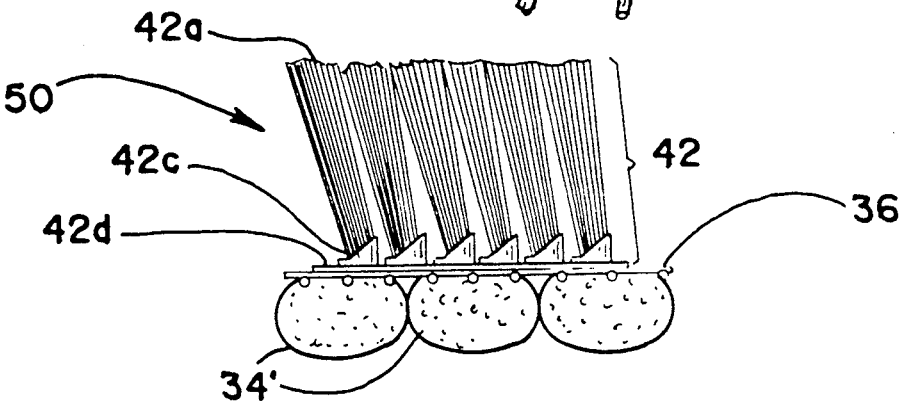
FIG. 5

METHOD FOR MANUFACTURING A WEB OF PLASTIC TURF FOR SPORTS GROUNDS

BACKGROUND AND SUMMARY OF THE INVENTION

This is a continuation of application Ser. No. 145,837 filed Jan. 20, 1988, now abandoned, the text of which is hereby incorporated by reference.

The invention relates to a method for manufacturing a web of plastic turf for sports grounds having a web of pile fabric forming the upper side and cushion elements attached in grating-type configuration to its underside. It is primarily a question of a method in which plastic turf such as disclosed in German Offenlegungsschrift (unexamined patent application) 2,051,108 is used.

To date, it has been standard practice for a plastic turf web with an elastomeric back coating substance provided on part of its underside, as disclosed, in particular, by German Offenlegungsschrift (unexamined patent application) 2,051,108, and a base fabric web consisting of coherent, pillow-shaped cushion elements made of foamed plastic material, preferably one such as that likewise disclosed in German offenlegungsschrift (unexamined patent application) 2,051,108, to be lastingly joined together by the back coating substance of the plastic turf web and the foamed, soft PVC forming the pillow-shaped cushion elements of the base fabric web on the upper side of the base fabric web being heated and the upper side of the base fabric web then being pressed against the underside of the plastic turf web and the two webs thereby being welded together—German Offenlegungsschrift (unexamined patent application) 3,113,636. This method does result in an excellent product, but is relatively costly as the base fabric web including a woven reinforcement fabric must first be manufactured in a separate manufacturing process. Finally, the prior art discloses a method in which a plastic turf web is laid on a conveyer belt with its back (underside) pointing upwards, plastic agglomerates consisting of a pasty, foamable soft PVC are deposited in grating-type configuration on it by a wiper drum, and the soft PVC is foamed by heating, polymerized and firmly bonded to the back of the plastic turf web so as to produce on its underside foamed plastic cushion elements arranged in grating-type configuration. However, a web of ground covering manufactured in this way cannot stand up to the demands made on a sports field when played on since the players exert pushing forces of quite a considerable magnitude on the ground covering.

The object underlying the invention is to provide a method for manufacturing a dimensionally stable and durable plastic turf web of the kind mentioned at the beginning which is inexpensive to perform. Starting from a method in which plastic agglomerates corresponding to the cushion elements are produced from a quantitatively regulatable plastic material from which an elastomer is formable by curing, and deposited in grating-type configuration, and in which the plastic material is then converted by heat treatment into the cushion elements and during this firmly bonded to the web of pile fabric. This object can be achieved, in accordance with the invention, by the web of pile fabric, the plastic agglomerates and a reinforcement web with openings therein being deposited on an endless conveyer belt such that the reinforcement web lies between the underside of the web of pile fabric and the plastic agglomerates. In the provided method, the plastic material penetrates the openings in the reinforcement web and wets the underside of the web of pile fabric. The plastic material is then heat treated and the web of pile fabric, the reinforcement web and the cushion elements are thereby firmly bonded to one another. Accordingly, with the inventive method, not only is the separate manufacture of a base fabric web eliminated, but also the reinforcement web is embedded in the cushion elements and firmly bonded by means of these to the back of the web of pile fabric. An extremely dimensionally stable product results which can stand up to the pushing forces occurring during play on a sports field. A ground covering manufactured in this way is nevertheless water-permeable if a water-permeable web of pile fabric is used. Accordingly, a preferred embodiment of the inventive method is characterized by use of a water-permeable web of pile fabric with an underside which is partly coated with such a back coating substance that this back coating substance forms a bond with the plastic material for the cushion elements. To optimize the dimensional stability of the inventive ground covering web, use of a plastic turf which has already been thermally fixed is recommended.

In the manufacture of a web of fabric with a resin coating which consists of synthetic resin agglomerates arranged in grating-type configuration and which is intended to be ironed-in, i.e., in a completely different field, it is already known—German Offenlegungsschrift (unexamined patent application) 1,933,180—FIGS. 1,2 and 5—to place the web of fabric which is to be coated on the upper strand of an endless conveyer belt. Synthetic resin agglomerates are then deposited on the fabric web in grating-type configuration using a wiper drum having a shell with discrete through-openings for a powdery synthetic resin. The web is then passed with the synthetic resin agglomerates under a heat radiator to sinter the synthetic resin powder and bond the synthetic resin to the fabric web. Finally, a second fabric web, i.e., a top fabric, is placed on the synthetic resin agglomerates which are still soft and sticky. The second fabric web is pressed into the agglomerates so as to join the two fabric webs. Apart from the fact that this prior art, as mentioned above, relates to a completely different technical field, the synthetic resin agglomerates produced by the known method are not cushion elements and the second fabric web is also not a reinforcement web with openings which are sufficiently large for the synthetic resin material to pass through these openings to enable the second fabric web to be embedded in the synthetic resin agglomerates. Accordingly, with this known method, the synthetic resin agglomerates always lie between the two fabric webs, whereas in the product manufactured by the inventive method, the reinforcement web lies in the cushion elements formed by the plastic agglomerates. Therefore, the plastic agglomerates in the finished product cannot be referred to as lying between the web of pile fabric and the reinforcement web. Consequently, in the inventive method, either the plastic agglomerates can first be deposited on the conveyer belt, and the reinforcement web and finally the web of pile fabric applied thereto, or the reinforcement web can first be deposited on the conveyer belt, followed by production and deposit of the plastic agglomerates thereon and finally application of the web of pile fabric thereto. Or, the pile of web fabric can first be placed on the conveyer belt with the pile facing downwards, the reinforcement web then placed on the web of pile fabric and, finally, the plastic agglomerates produced thereon.

The plastic agglomerates can be produced and deposited individually or in groups by a single nozzle or a set of nozzles. However, it is simpler and less expensive to produce and deposit the plastic agglomerates continuously by means of a wiper drum having a shell with discrete through-openings for the plastic material. In this case, the plastic material is fed by way of the drum cavity and applied to the inner side of the drum shell which is provided with the through-openings and with which a wiper cooperates.

In principle, any plastic which can be worked in the form of a paste, granulate, powder or the like and which can be converted by heat treatment into the cushion elements is suitable for the cushion elements. However, for cost reasons, it is particularly recommendable to use a foamable soft PVC as plastics material.

The plastic material may also be one which cures by itself with time or, for example, solidifies into an elastomer on account of the humidity of the air after the plastic agglomerates have been produced. However, for easier controllability of the solidifying procedure and also for cost reasons, use of a plastic material which can be converted by heat treatment into the cushion elements is recommended. Accordingly, in a preferred embodiment of the inventive method, the conveyer belt with the plastic agglomerates, the reinforcement web and the web of pile fabric is conducted through a heating zone for heat treatment of the plastic material. In order to avoid deformation of the pile of the plastic turf in an undesired manner, it is recommended that the web of pile fabric be cooled from the pile side in the heating zone.

The reinforcement web can, for example, be a tension-proof, perforated foil. However, it is preferable to use a large-meshed, gauze-like woven or knitted fabric with a finish which prevents thread slide. Use of a glass fiber fabric is, for example, recommended as such a reinforcement web can be particularly easily and effectively embedded in the plastic material later forming the cushion elements and effectively lends dimensional stability to the manufactured ground covering. A finish which prevents thread slide is to be understood as inability of the points of intersection of the threads from which the reinforcement web has been made to be moved along the threads as would be the case, for example, in a normal fabric with large openings.

Further features, advantages and details of the invention are apparent from the following description and the accompanying drawings of three particularly advantageous embodiments of the inventive method and of inventive systems for performing these methods. In the drawings:

DESCRIPTION OF THE DRAWING

FIG. 2 shows a section from FIG. 1 illustrating the region in which the plastic agglomerates are deposited on the conveyer belt, on a larger scale than in FIG. 1, but without the conveyer belt;

FIG. 3 is a plan view of a region of the conveyer belt with plastic agglomerates deposited on it (viewed in the direction of arrow A in FIG. 1);

FIG. 4 is a view of the web of pile fabric forming a plastic turf web, from below, viewed in the direction of arrow B in FIG. 1, but without the back coating;

FIG. 5 shows section C from FIG. 1 on a larger scale, but without the conveyer belt, i.e., a vertical section through the web of ground covering after foaming-up of the plastic material;

DESCRIPTION OF THE PREFERRED EMBODIMENTS

Figure 1:
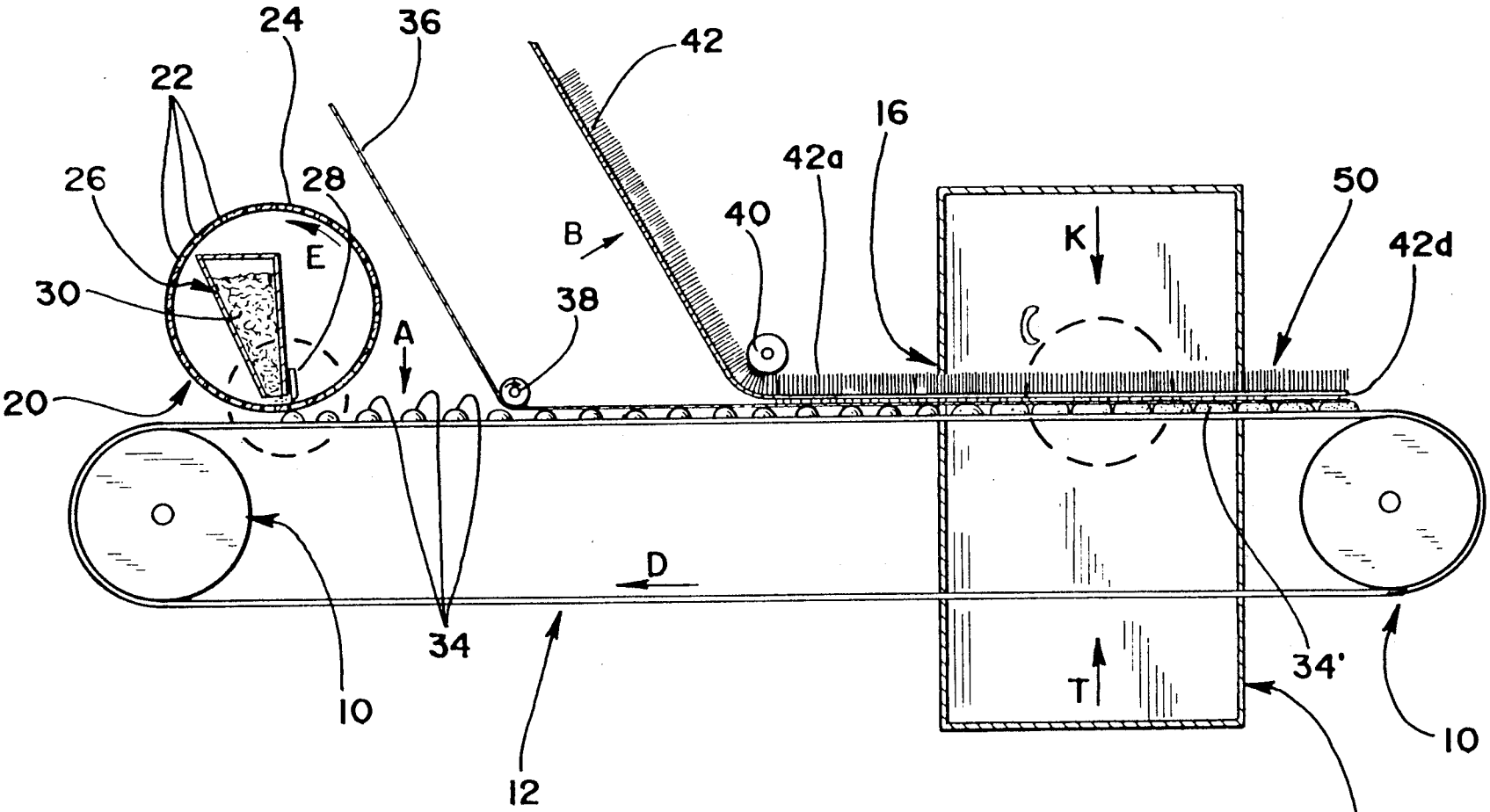
FIG. 1 is a schematic illustration of the first system, more particularly, in a side view, but with the wiper drum shown in section.

FIG. 1 shows two deflection rollers 10, one of which is driven by means which are not illustrated. An endless conveyer belt 12 in the form of a thin, flexible steel band for which a tension roller, not illustrated, may be provided, is laid over this deflection roller. The conveyer belt travels through an oven 14 whose side walls are provided with openings 16 for the conveyer belt and the web of ground covering which is to be manufactured to pass through. Arrows T and K indicate that the web of ground covering which is to be manufactured is heated from below and cooled from above in this oven.

Arranged above the starting area of the upper strand of the conveyer belt 12, whose direction of travel is indicated by arrow D, is an applicator drum 20 which is mounted for rotation about a horizontal axis and has a drum shell 24 which is provided with through-openings 22. The through-openings 22 are designed and arranged in accordance with the grating to be formed by the plastic agglomerates which are to be deposited on the conveyer belt 12. A stationary feeding device 26 for the plastic material is located inside the applicator drum 20, with a wiper 28 arranged stationarily beside it. The applicator drum 20 is driven by means, not illustrated, in the direction of arrow E. As is clearly apparent from FIG. 2, plastic material 30 which has been applied by feeding device 26 to the inner side of drum shell 24 is pressed through openings 22 and wiped off the drum shell by wiper 28, and the plastic material 30 pressed through openings 22 forms on conveyer belt 12 plastic agglomerates 34 in accordance with the desired grating. The consistency and the feeding pressure of plastic material 30 and also the size and arrangement of through-openings 22 are preferably matched so that plastic agglomerates 34 first lie separately from one another on conveyer belt 12 and, in particular, are of pillow-type or drop-shaped configuration.

A reinforcement web 36 is supplied at a point following applicator drum 20 in the direction of travel of conveyer belt 12. In particular, this is a fabric which is comprised of plastic ribbons with a finish to prevent thread slide and which has relatively large openings. A deflection roller 38 for reinforcement web 36 is rotatably mounted above conveyer belt 12. Its distance from the upper strand of conveyer belt 12 is such that the reinforcement web is first laid only loosely on plastic agglomerates 34. A longitudinal pull is exerted on reinforcement web 36 by the finished web of ground covering being withdrawn rightwardly from the system, in accordance with FIG. 1, for which conventional means, not illustrated, can be used.

A second deflection roller 40 serves to press a water-permeable plastic turf web 42, more particularly, as described in German Patent 2,051,108, onto the deposited reinforcement web 36 and the plastic agglomerates 34. As a result of this, the reinforcement web 36 is pressed into the plastic material of the plastic agglomerates 34 and the plastics material comes into contact with the underside of plastic turf web 42. In this connection, it should be noted that plastic turf web 42 is fed such that its pile 42*a* points upwards after the plastic turf web has been deposited on conveyer belt 12.

In oven 14, the plastic material, preferably a soft PVC which can be foamed up, is foamed up by heating and, at the same time, solidified and firmly bonded to the back coating substance of plastic turf web 42, with the pile 42*a* of the plastic turf web being simultaneously cooled from above. FIG. 5 clearly shows the structure of the back of plastic turf web 42. It has a textile support to hold the pile 42*a* and, between openings 42*b*, ribs 42*c* which are formed by the points at which pile 42*a* is bound into the textile support and which during manufacture of the plastic turf are already coated with a back coating substance, not illustrated in FIG. 4, which becomes bonded to the plastic material of the plastic agglomerates 34.

By way of this and by the foaming-up of the plastic material, the finished ground covering web 50 is obtained and consists of pile 42*a* and textile support 42*d* of plastic turf web 42, reinforcement web 36 and foamed plastic cushion elements 34', with these being produced by heat treatment of the plastic agglomerates 34 and firmly bonded to plastic turf web 42.

As mentioned above, ground covering web 50 is drawn off to the right, in accordance with FIG. 1, after leaving oven 14. This may be carried out by a second endless conveyer belt, not illustrated, which, in particular, is a supporting grid with rows of nails at the longitudinal edges to keep the ground covering web in shape during further cooling. The edges of the ground covering web can then be trimmed and the ground covering web rolled up.

The inventive method not only results in reduction of the cost of manufacturing the ground covering web but also in elimination of some of the risks involved in numerous separate-manufacturing processes.

In accordance with the invention, the plastic agglomerates are of such dimensions, are deposited at such spacings from one another and are so treated that the cushion elements finally formed by them include openings between them to enable water collecting on the upper side of the ground covering to flow or trickle down.

Instead of a pasty plastic material, it is also possible to deposit on conveyer belt 12 plastics material which is capable of being heaped up, more particularly, in powder or granulate form, and which can be sintered together or molten together and foamed up in oven 14 so as to obtain from the discrete plastic agglomerates cushion elements which leave openings between them but are preferably interconnected.

Figure 6:
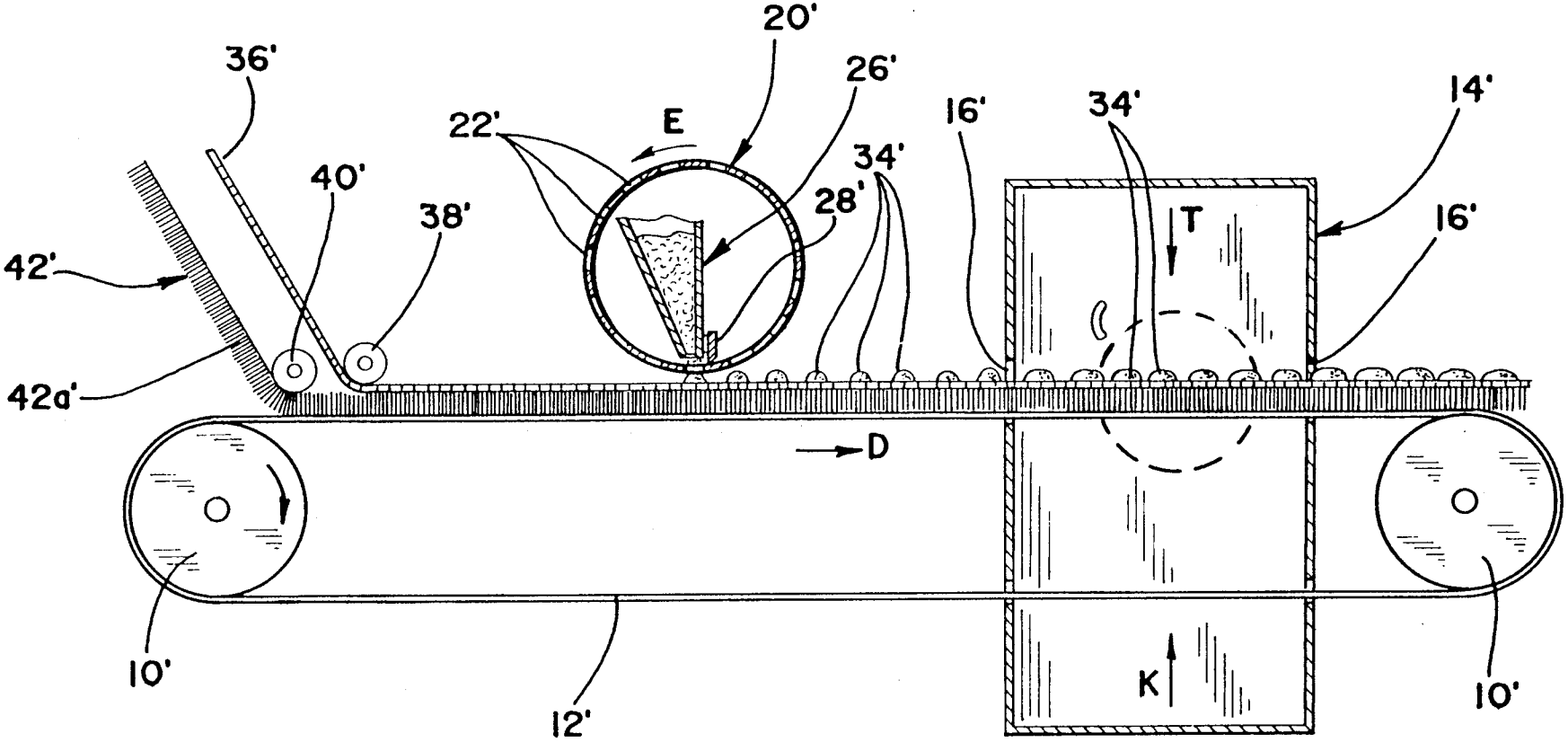
FIG. 6 is a schematic illustration corresponding to FIG. 1 of a second system.

The inventive system illustrated in FIG. 6 and the inventive method performed with it differ from the system and method according to FIG. 1 only by the sequence in which the various elements of the plastic turf web are deposited on the conveyer belt. Accordingly, the same reference numerals have been used in FIG. 6 as in FIG. 1; but with the addition of an apostrophe.

In this preferred embodiment, the plastic turf web 42' is first deposited on conveyer belt 12' with its pile 42*a'* facing downwards. A reinforcement web 36' is then deposited on the underside of plastic turf web 42'. Thereafter, plastic agglomerates 34' are produced and applied to reinforcement web 36' and plastic turf web 42' by applicator drum 20'. As the plastic turf web travels through an oven 14', pile 42*a'* is cooled from below, as indicated by arrow K, while plastic agglomerates 34' undergo heat treatment by means of which they are foamed-up and stabilized with respect to shape so as to form foamed plastic cushion elements 34''.

Openings in oven 14' for the composite plastic turf web and conveyer belt 12' to travel through have been designated by 16'. As plastic agglomerates 34' travel through oven 14' the plastic material penetrates reinforcement web 36'' and, in this way, foamed plastic cushion elements 34'' and reinforcement web 36' become firmly bonded to the later underside of plastic turf web 42'.

Figure 7:
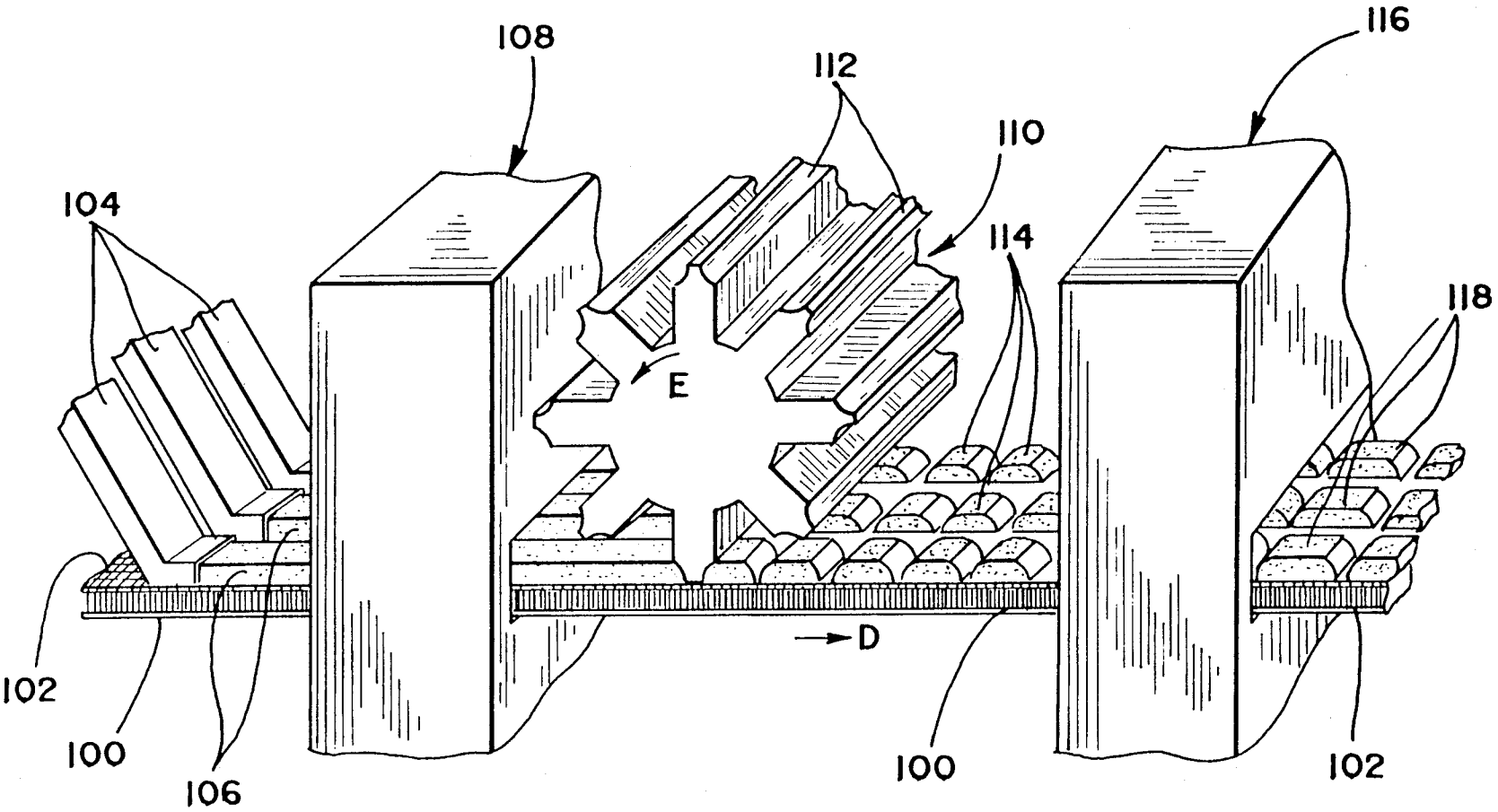
FIG. 7 shows a section from a third system, with parts of the conveyer belt and its deflection rollers omitted.

A particularly simple way of producing elastomeric cushion elements arranged in grating-type configuration on the underside or rear side of a web which may either be a plastic turf web or a supporting web which is arranged underneath the actual plastic turf web after it has been laid, is shown in FIG. 7 in which, for reasons of simplicity, only the upper strand of conveyer belt 12 or 12' has been illustrated without deflection rollers 10 or 10'.

In the method performed with this system, a supporting web 102 is first deposited on a conveyer belt 100. If this is a plastic turf web it is deposited on the conveyer belt with its pile facing downwards. The direction of travel of the upper strand of conveyer belt 100 has again been indicated by an arrow D. With a set of nozzles 104 arranged in transversely spaced relation to one another, plastic strands 106 are then produced and deposited on supporting web 102. The plastic strands 106 which are similarly arranged in transversely spaced relation to each other extend in the direction of travel and hence in the longitudinal direction of supporting web 102. The plastic material is preferably a PVC plastisol and the supporting web 102 a textile web with a lattice structure which enables the plastisol to pass through the openings in the supporting web.

The plastic strands 106 then travel through a first oven 108 in which heat acts upon the plastic strands from above while the supporting web 102 may be cooled from below. Temperature and transit time are set so that the plastic material of plastic strands 106 is somewhat stabilized with respect to shape and is no longer sticky after leaving oven 108. In the case of a plastisol, it is, therefore, caused to gel slightly. The supporting web 102 including plastic strands 106 then passes under a roller 110 which is provided with ribs 112 which in ,cross section are similar to a pressure stamp. The access of roller 110 extends transversely to the direction of travel D and it is driven by means, not illustrated, in the direction of arrow E and spaced above conveyer belt 100 such that ribs 112 press right through plastic strands 106 onto supporting web 102. This produces on supporting web 102 a grating-type arrangement of unfinished cushion elements 114 which travel through a second oven 116 where they are foamed-up and stabilized with respect to shape to produce finished, pillow-shaped cushion elements 118. In the second oven 116, too, heat acts on the plastic material from above while conveyer belt 100 and supporting web 102 may be cooled from below.

In accordance with the invention, plastic strands 106 are arranged in such transversely spaced relation to one another and ribs 112 are so designed and arranged that when supporting web 102 is laid with the cushion elements 118 facing downwards on a water-impermeable base, water which penetrates supporting web 102 from above can flow off in all directions between cushion elements 118.

The supporting web 102 in the inventive method shown in FIG. 7 can, of course, also be a composite web, more particularly, a plastic turf web deposited on the conveyer belt with its pile facing downwards and a further web made from a woven or knitted fabric with a lattice structure or the like deposited on the plastic turf web.

What is claimed is:

1. A method for manufacturing a water-permeable web with resilient cushion elements for synthetic turf, comprising the steps of:

(a) providing a longitudinally extending supporting web having water drainage openings therethrough and defining a longitudinal direction;

(b) depositing plastic material adapted to be solidified by heat treatment, in the form of elongate, spaced, rib-shaped plastic agglomerate strips on said supporting web in such manner that said rib-shaped agglomerate strips extend in the longitudinal direction of the supporting web and are transversely spaced in relation to one another and uncovered, water-permeable portions of the supporting web are provided between the strips;

(c) mechanically dividing said rib-shaped agglomerate strips transversely to their longitudinal direction into a series of spaced, unfinished cushion elements and simultaneously forming spaced transverse water drainage channels through each of said agglomerate strips between said unfinished cushion elements, and (d) converting said unfinished cushion elements into said resilient cushion elements while maintaining the spaced relationships by heating the plastic material and thereby simultaneously bonding said resilient cushion elements to the supporting web.

2. A method for manufacturing a water-permeable web with resilient cushion elements for synthetic turf, comprising the steps of:

(a) providing a longitudinally extending supporting web having openings therein and defining a longitudinal direction;

(b) depositing a plastic material adapted to be solidified by heat treatment, in the form of elongate, spaced, rib-shaped plastic agglomerate strips on said supporting web such that said rib-shaped agglomerate strips extend in the longitudinal direction of the supporting web and are transversely spaced in relation to one another and uncovered, water-permeable portions of the supporting web are provided between the strips;

(c) mechanically dividing said rib-shaped agglomerate strips transversely to their longitudinal direction into a series of spaced unfinished cushion elements; and (d) converting said unfinished cushion elements into said resilient cushion elements while maintaining the spaced relationships by heating the plastic material and thereby also bonding said resilient cushion elements to the supporting web.

3. The method of claim 1 or 2, wherein said rib-shaped agglomerates are divided into said unfinished cushion elements by a ribbed roller whose axis and ribs extend transversely to the longitudinal direction of the supporting web.

4. The method of claim 3, wherein the ribs of said roller are pressed through the plastic material of said rib-shaped plastic agglomerates onto the supporting web.

5. The method of claim 1 or 2, wherein said rib-shaped plastic agglomerates are heat treated to such an extent prior to the step of dividing said plastic agglomerates that the plastic material will not adhere to a means for dividing the rib-shaped agglomerates.

6. The method of claim 1 or 2, wherein a plastisol which is gelled slightly prior to the dividing is used to form said rib-shaped plastic agglomerates.

7. The method of claim 1 or 2, in which said water permeable web comprises a water permeable web of plastic turf having an underside and a pile fabric upperside and which is supported on its pile fabric upperside during the deposition of said plastic agglomerates on the underside.

8. The method of claim 7, in which said water permeable web comprises a discrete web of fabric which is supported on the underside of a plastic turf during the deposition of said plastic agglomerates.

9. The method of claim 7 in which the transverse water drainage channels formed in said rib-shaped agglomerates are transversely aligned.

* * * * *

UNITED STATES PATENT AND TRADEMARK OFFICE

CERTIFICATE OF CORRECTION

PATENT NO. : 5,019,194

DATED : May 28, 1991

INVENTOR(S) : Hans-Joachim Friedrich

It is certified that error appears in the above-identified patent and that said Letters Patent is hereby corrected as shown below:

Column 5, line 42 delete hyphen between "separate" and "manufacturing";

Column 6, line 14 delete "36'''" and substitute therefor -- 36' --;

Column 8, line 46 delete "claim 7" and substitute therefor -- claim 1 --.

Signed and Sealed this

Twenty-second Day of June, 1993

*Attest:*

Michael K. Kirk

MICHAEL K. KIRK

*Attesting Officer*

*Acting Commissioner of Patents and Trademarks*